US008555899B2

(12) United States Patent
Langford et al.

(10) Patent No.: US 8,555,899 B2
(45) Date of Patent: Oct. 15, 2013

(54) HAIRDRESSER'S MASKING SHEET

(75) Inventors: Anthony Langford, Halesworth (GB); Nicholas Wilkins, Daventry (GB)

(73) Assignee: Kirnan Holdings, Ltd., Northamptonshire (GB)

( * ) Notice: Subject to any disclaimer, the term of this patent is extended or adjusted under 35 U.S.C. 154(b) by 874 days.

(21) Appl. No.: 11/895,468

(22) Filed: Aug. 24, 2007

(65) Prior Publication Data

US 2008/0072919 A1 Mar. 27, 2008

(51) Int. Cl.
*A45D 19/18* (2006.01)
*A61K 8/18* (2006.01)

(52) U.S. Cl.
USPC ..... 132/270; 132/222; 132/202

(58) Field of Classification Search
USPC ..... 132/208, 222, 270
See application file for complete search history.

(56) References Cited

U.S. PATENT DOCUMENTS 5,287,864 A * 2/1994 Gallo ..... 132/208
5,335,679 A 8/1994 Baxter ..... 132/270

FOREIGN PATENT DOCUMENTS

| | | | |
|---|---|---|---|
| EP | 0624324 | | 11/1994 |
| GB | 2140682 A | * | 12/1982 |
| GB | 2349816 | | 11/2000 |
| GB | 2373184 | | 7/2003 |
| WO | WO 2004/073447 | | 9/2004 |

* cited by examiner

*Primary Examiner* — Rachel Steitz
(74) *Attorney, Agent, or Firm* — Nixon & Vanderhye P.C.

(57) ABSTRACT

A hairdresser's masking sheet of flexible material masks selected strands of a head of hair from other strands of the hair while selected strands are treated. The sheet has a substrate (120) of flexible material and an adhesive portion (160). Application of the adhesive portion to a portion of the head of hair selectively and removably unites the sheet with strands of the portion of hair thereby brought into contact therewith. The sheet has a stiffening strip (180) operative to provide the sheet with longitudinal stiffness.

5 Claims, 3 Drawing Sheets

HAIRDRESSER'S MASKING SHEET

RELATED APPLICATION DATA

This application claims priority from GB Patent Application No. 0503763.5, filed Feb. 24, 2005, which is incorporated herein in its entirety by reference hereto.

BACKGROUND OF THE INVENTION

1. Field of the Invention

This invention relates to a hairdresser's aid and, more particularly, to a stiffened masking sheet of flexible material for masking selected strands of a head of hair from other strands of hair, while the selected strands are treated, such as by being subjected to a setting process and/or to bleaching or coloring process.

2. Description of the Prior Art

Masking sheets are generally known in the hairdressing art. For example, GB2140682 discloses a masking sheet. The prior art masking sheet is illustrated in FIGS. 1 to 3. Here there is shown a rectangular elongate sheet 1 comprising a rectangular panel 2 of white substantially opaque plastics material and a rectangular panel 3 of substantially transparent plastics material. The panels 2 and 3 are of substantially equal area and are welded one to another along a common edge, or co-extruded, to form a transversely extending hinge 4. An upper transverse marginal edge portion 5 of the panel 2 is joined to an adhesive tape 6 having pressure sensitive contact adhesive applied to a surface thereof, which tape has a margin 7 free of adhesive.

In use, strands of a head of hair are selected by a technique known as "weaving" and the panel 2 is placed under selected strands of hair, as shown at 8 in FIG. 3, of a head of hair 9 such that the margin 7 is located adjacent the scalp of the head 9. The adhesive tape 6 adheres to the selected strands of hair 8 adjacent the scalp such that the sheet 1 is located under and relative to the selected strands of hair 8.

The selected strands of hair 8 subsequently are coated with a liquid coloring substance (not shown) and the panel 3 is folded about the hinge 30 4 and is superimposed on the panel 2 with the selected strands of hair 8 located there between, a transverse marginal edge portion of the panel 3 adhering to the marginal edge portion 5 of the panel 2 by means of the adhesive tape 6 such that a margin 10 of the panel 3 is located adjacent the margin 7.

In this manner, the selected strands of hair 8 are located within an envelope defined by the panels 2 and 3, the hinge 4 and the adhesive tape 6, as shown at 11 in FIG. 3, and are thus isolated from adjacent strands of hair while coloration of the selected strands of hair is completed.

It will be seen that this method involves the step of placing panel 2 under selected strands of hair 8. A hairdresser will do this by lifting of the selected strands of hair 8 with one hand, whilst using the other hand to place panel 2. It has been found that the panel will crumple as it is placed under the selected strands of hair 8. This believed to be because the panel of the known masking sheet is not sufficiently stiff longitudinally.

GB 2140682 discloses stiffening panel 2 by making margin 7 and adhesive tape 6 less flexible. However this does not solve the problem. It also suggests making panel 2 thicker. However, this substantially increases the costs of manufacture as well as making the masking sheet more difficult to mass produce.

A way to ameliorate these problems has been sought.

SUMMARY OF THE INVENTION

According to the present invention, there is provided a hairdresser's masking sheet of flexible material for masking selected strands of a head of hair from other strands of the hair while selected strands are treated, wherein the sheet comprises a substrate of flexible material and an adhesive portion whereby application of the adhesive portion to a portion of the head of hair selectively and removably unites the sheet with the strands of the portion of hair thereby brought into contact therewith characterized in that the sheet comprises a stiffening strip so as to provide the sheet with longitudinal stiffness.

It has surprisingly been found that the inclusion of the stiffening strip is sufficient to overcome the problem with the masking sheet crumpling on application but without substantially increasing the costs of manufacture or making the masking sheet difficult to manufacture.

The stiffening strip is preferably positioned adjacent the adhesive portion and, more preferably, is positioned parallel to the adhesive portion. The advantage of positioning of the stiffening strip adjacent the adhesive portion is that this arrangement particularly enhances the longitudinal stiffness of the masking sheet. This is because in the prior art masking sheet, the join between panel 2 and adhesive tape 6 would appear to act as a hinge. In this way, the join facilitates the crumpling of the prior art masking sheet when it is applied to a person's head. In contrast in the present invention, the arrangement of the stiffening strip next to the adhesive portion prevents the formation of a hinge but instead provides longitudinal stiffness, particularly by laminating the adhesive portion to the substrate.

According to the present invention, there is further provided a method of manufacturing a masking sheet, which method comprises providing a strip of adhesive plastics material, providing a first panel of plastics material, placing the first panel on the strip of adhesive plastics material, such that the panel overlaps the strip and such that a stiffening strip is formed where the panel overlaps the strip wherein the stiffening strip has a depth sufficient to provide the sheet with longitudinal stiffness.

The method of the invention preferably includes the steps of providing a second panel of plastics material; and joining the first panel of plastics material to the second panel of plastics material such that the join between the two panels acts as a hinge.

BRIEF DESCRIPTION OF THE DRAWINGS

The invention will now be illustrated by way of example with reference to the Figures of the accompanying drawings in which.

DETAILED DESCRIPTION OF THE INVENTION

Figure 4:
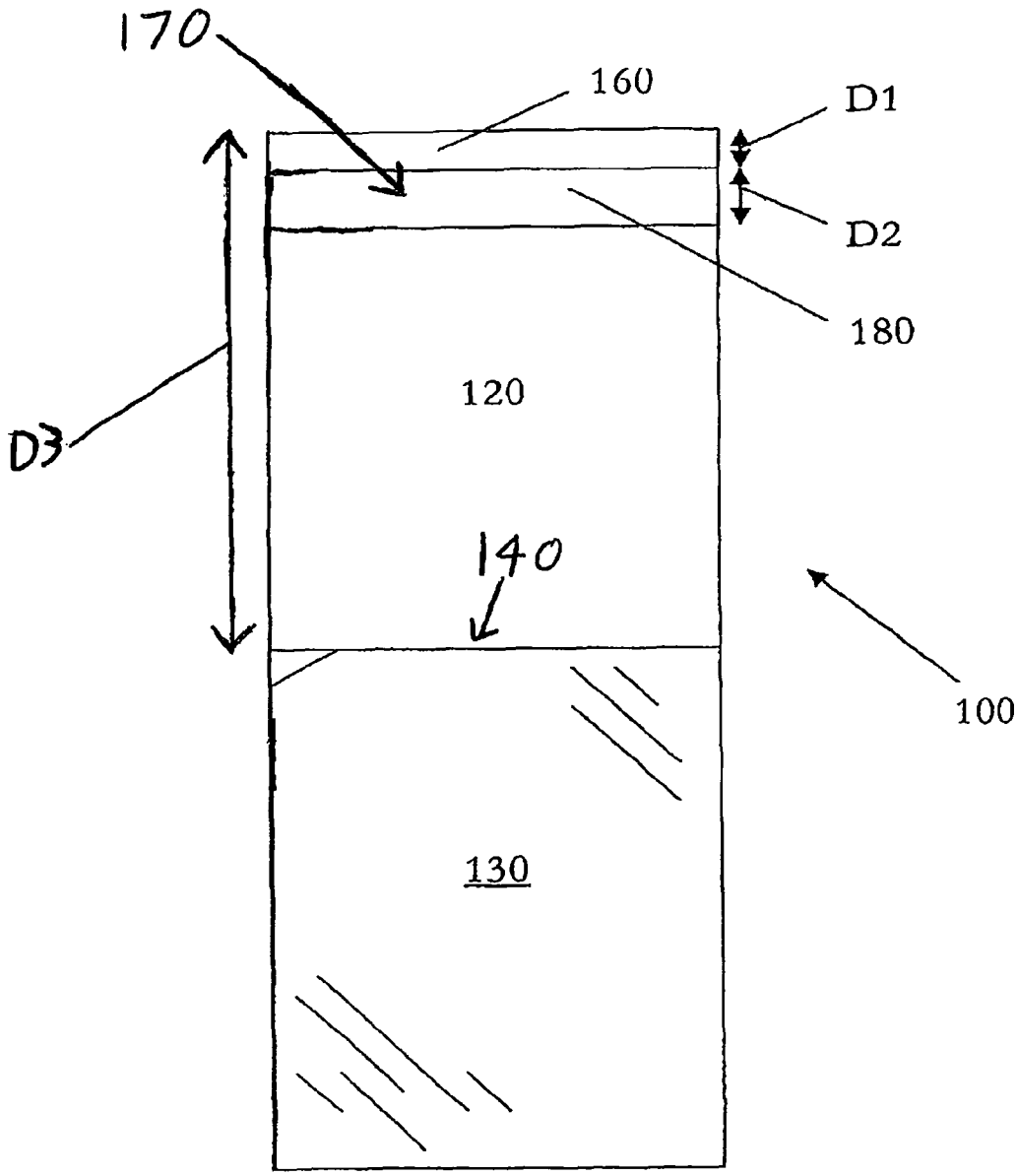
FIG. 4 is a plan view of a sheet according to the present invention.

Referring now to FIG. 4 of the drawings, there is shown a rectangular elongate sheet 100 comprising an adhesive portion 160, a rectangular panel 120 of white substantially opaque plastics material and a rectangular panel 130 of substantially transparent plastics material.

The adhesive portion 160 is provided by adhesive tape indicated generally at 170. Panel 120 is placed on adhesive tape 170 such that panel 120 30 overlaps with adhesive tape 170. The part of the adhesive tape 170 which overlaps with panel 120 provides a stiffening strip 180. Adhesive tape 170 is formed from substantially stiffer plastics material than that used to form panel 120 or panel 130.

The adhesive used in the adhesive portion 160 or in the adhesive tape 170 is optionally a water-soluble or water-dispersible adhesive such that the masking sheet 100 may be readily removed from a subject's hair by the washing step used to rinse away any treatment applied to the hair.

The ratio of the depth of the stiffening strip 180 (labeled as D2 in FIG. 4) to the depth of the adhesive portion 160 (labeled as D1 in FIG. 4) is preferably from 0.5:1, more preferably from 1:1 to 3:1, more preferably to 2:1; most preferably the ratio of D2 to D1 is about 1:1 or about 1.4:1. The ratio of the depth of the stiffening strip 180 D2 to the combined depth of panel 120 and adhesive portion 160 (labeled as D3 in FIG. 4) is preferably from 1:8 to 1:12, more preferably about 1:10.

Figure 1:
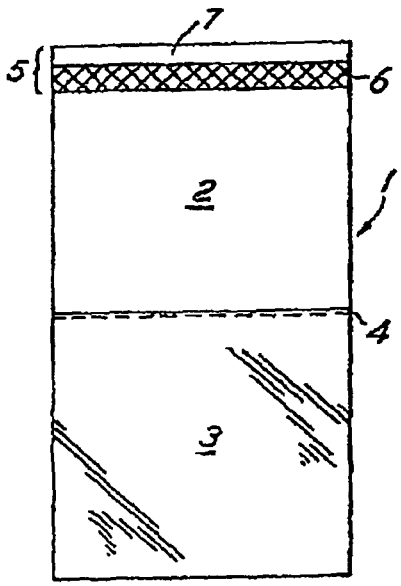
FIG. 1 is a plan view of a prior art sheet.
Figure 2:
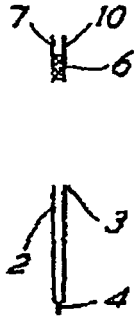
FIG. 2 is a cross-section of the sheet shown in FIG. 1 when in use.
Figure 3:
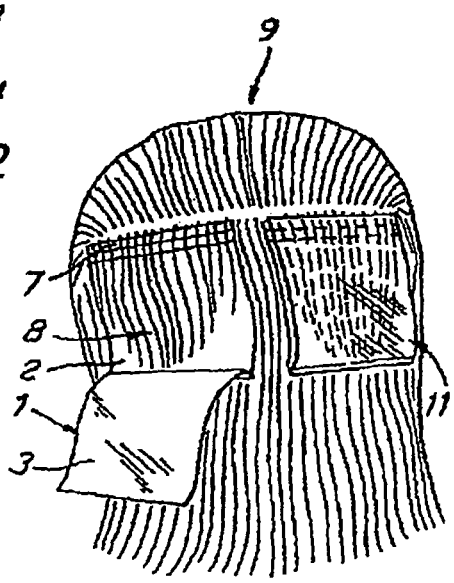
FIG3 PRIOR ART
FIG. 3 is a diagrammatic representation of the sheet shown in FIG. 1 in use.

In one example of masking sheet 120, D1 is 1.8 cm, D2 is 1.8 cm and D3 is 18.9 cm. In a further example of masking sheet 120, D1 is 1.7 cm, D2 is 2.3 cm and D3 is 19 cm. In an additional example of masking sheet 120, D1 is 1.4 cm, D2 is 1.9 cm and D3 is 18.9 cm. In all examples, the depth of panel 130 is substantially the same as depth D3 and the width of the masking sheet is about 9.4 cm. These measurements for D1, D2 and D3 are accurate to within plus or minus 1 mm. In the prior art sheet illustrated in FIG. 1, the measurement equivalent to depth D2 is about 0.4 mm. Thus the area on prior art sheet 1 which is adjacent to adhesive strip 6 which serves to link adhesive strip 6 to panel 2 does not function as a stiffening strip 180 because it lacks sufficient depth.

The panels 120 and 130 are welded together along their upper and lower edges (respectively), or co-extruded, to form a transversely extending hinge 140. The panels 120 and 130 have the same width but panel 130 has a greater depth such that when it is pivoted about a hinge 140, it overlaps with panel 120 and its upper edge is substantially coincident with the upper edge of adhesive portion 160. Thus panel 130 can be used to protect the adhesive of adhesive portion 160 before use. The masking sheet 100 may be used in the same manner as hereinbefore described for prior art masking sheet 1.

Figure 5:
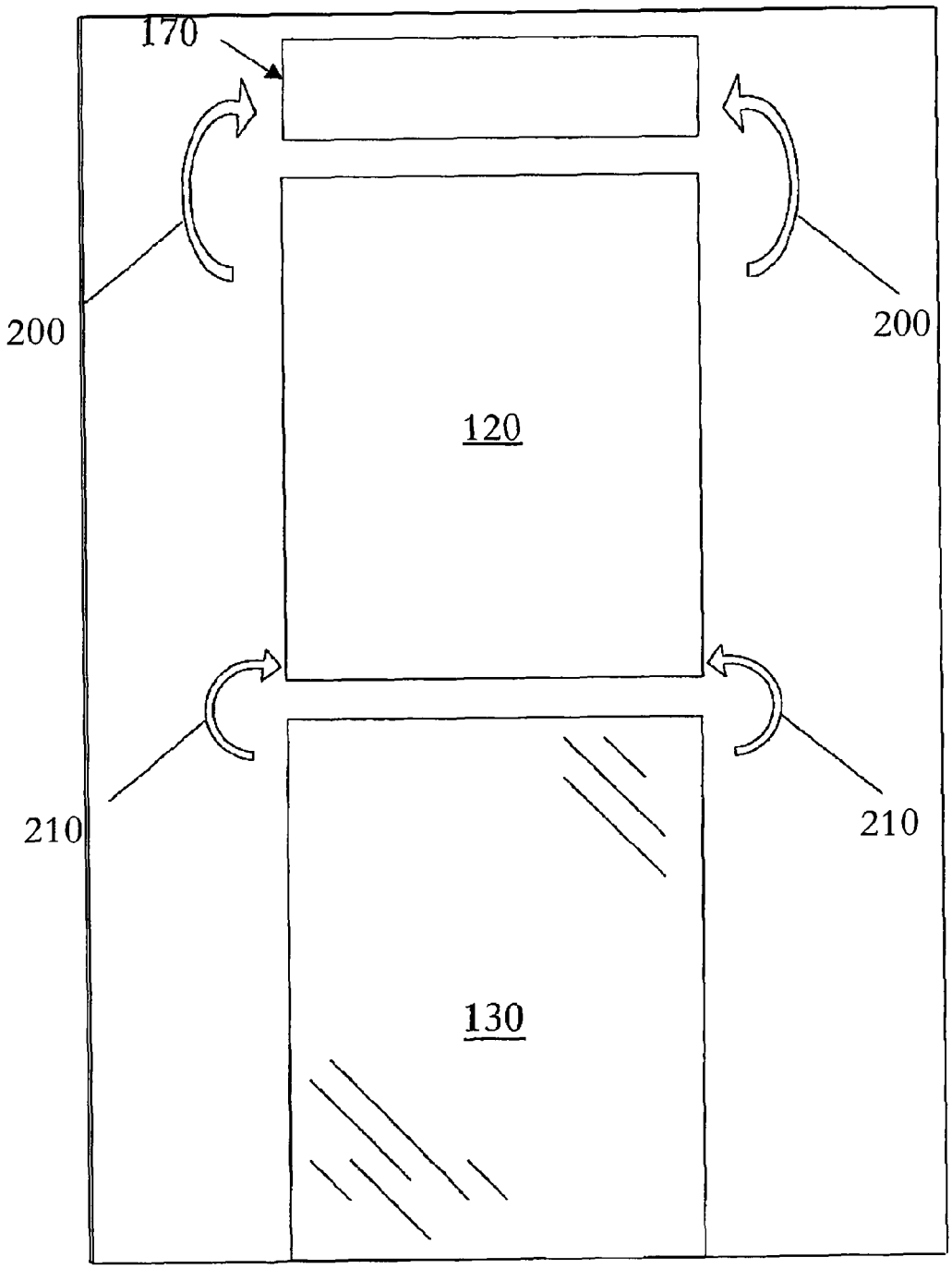
FIG. 5 is a schematic view of the method according to the present invention for preparing a sheet according to the invention.

The preparation of masking sheet 100 is illustrated schematically in FIG. 5. The first step comprises providing a suitable length of adhesive tape 170, and panels 120 and 130. The second step optionally comprises adhering panel 120 to adhesive tape 170 as shown by arrows 200 and then panels 120 and 130 may be welded together to form hinge 140 as shown by arrows 210. Alternatively of the first step comprises welding together panels 120 and 130 to form hinge 140 first and then adhering panel 120 to adhesive tape 170. As a further alternative, panels 120 and 130 and hinge 140 may be provided as a single co-extruded unit (not shown) which is then adhered to the adhesive tape 170 as shown by arrows 200.

Adhesive portion 160 is optionally provided with a release paper (not shown) such as silicone coated paper to protect the adhesive before use. Alternatively panel 130 may be folded over panel 120 and adhesive portion 160 to releasably protect the adhesive portion 160.

The invention claimed is:

1. A hairdresser's masking sheet of flexible material for masking selected strands of a head of hair from other strands of the hair while selected strands are treated, wherein the sheet consists of a substrate of flexible material and an adhesive portion, wherein the adhesive portion consists of an adhesive tape, whereby application of the adhesive portion to a portion of the head of hair selectively and removably unites the sheet with the strands of the portion of hair thereby brought into contact therewith, wherein the sheet further consists of a stiffening strip positioned adjacent to the adhesive portion so as to provide the sheet with longitudinal stiffness, and wherein the stiffening strip consists of the adhesive tape partially overlapping the substrate, and wherein the substrate consists of a backing panel hinged to a front panel.

2. A sheet as defined in claim 1 wherein the adhesive is water soluble or water dispersible.

3. A sheet as defined in claim 1 wherein the stiffening strip has a depth and the adhesive portion has a depth and wherein the ratio of the depth of the stiffening strip to the depth of the adhesive portion is from 1:1 to 2:1.

4. A method of manufacturing a masking sheet according to claim 1, which method comprises:

providing a strip of adhesive tape, providing a first panel of plastics material, placing the first panel on the strip of adhesive tape such that the panel overlaps the strip and such that a stiffening strip is formed where the panel overlaps the strip wherein the stiffening strip has a depth sufficient to provide the sheet with longitudinal stiffness.

5. A method as defined in claim 4 which includes the steps of providing a second panel of plastics material.

joining the first panel of plastics material to the second panel of plastics material such that the join between the two panels acts as a hinge.

* * * * *